US010450906B2

(12) United States Patent
Mukaide et al.

(10) Patent No.: US 10,450,906 B2
(45) Date of Patent: Oct. 22, 2019

(54) VALVE OPENING AND CLOSING TIMING CONTROL APPARATUS

(71) Applicant: AISIN SEIKI KABUSHIKI KAISHA, Kariya-shi, Aichi-ken (JP)

(72) Inventors: Hiroki Mukaide, Chiryu (JP); Eiji Miyachi, Nishio (JP); Yoshiaki Iguchi, Kariya (JP); Tomoharu Otake, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 10 days.

(21) Appl. No.: 15/769,186

(22) PCT Filed: Sep. 16, 2016

(86) PCT No.: PCT/JP2016/077523
§ 371 (c)(1),
(2) Date: Apr. 18, 2018

(87) PCT Pub. No.: WO2017/110172
PCT Pub. Date: Jun. 29, 2017

(65) Prior Publication Data

US 2018/0306070 A1 Oct. 25, 2018

(30) Foreign Application Priority Data

Dec. 21, 2015 (JP) ..... 2015-249014

(51) Int. Cl.
*F01L 1/352* (2006.01)

(52) U.S. Cl.
CPC ..... *F01L 1/352* (2013.01); *F01L 2250/02* (2013.01); *F01L 2250/04* (2013.01); *F01L 2820/032* (2013.01)

(58) Field of Classification Search
CPC ..... F01L 1/352; F01L 1/46; F01L 2013/103; F01L 2820/032
(Continued)

(56) References Cited

U.S. PATENT DOCUMENTS 6,138,622 A 10/2000 Heer
2003/0226532 A1* 12/2003 Takenaka ..... F01L 1/352 123/90.17
(Continued)

FOREIGN PATENT DOCUMENTS

JP S-62-101943 A 5/1987
JP 2004-003419 A 1/2004

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) dated Jul. 5, 2018, by the International Bureau of WIPO in corresponding International Application No. PCT/JP2016/077523. (8 pages).
(Continued)

*Primary Examiner* — Jorge L Leon, Jr.
(74) *Attorney, Agent, or Firm* — Buchanan Ingersoll & Rooney PC

(57) ABSTRACT

A phase adjustment mechanism is constructed as a differential deceleration mechanism where a ring gear is relatively rotated on a basis of a difference in the number of teeth between the ring gear and an inner gear by revolution of an eccentric axis with reference to a rotation axis by an electric actuator. A coupling member is provided including a first engagement portion engaging with a driving-side rotational member in a displaceable manner in a first direction serving as a radial direction and a second engagement portion
(Continued)

engaging with the inner gear in a displaceable manner in a second direction orthogonal to the first direction.

2 Claims, 4 Drawing Sheets

(58) Field of Classification Search
USPC ..... 123/90.15, 90.31
See application file for complete search history.

(56) References Cited

U.S. PATENT DOCUMENTS

2005/0199201 A1* 9/2005 Schafer ..... F01L 1/022 123/90.17
2006/0236965 A1 10/2006 Schaefer et al.
2007/0051331 A1* 3/2007 Uehama ..... F01L 1/022 123/90.17
2007/0163526 A1* 7/2007 Sugiura ..... F01L 1/352 123/90.17
2010/0269770 A1* 10/2010 Kokubo ..... F01L 1/022 123/90.15
2011/0265747 A1* 11/2011 Tadokoro ..... F01L 1/344 123/90.15
2012/0174883 A1* 7/2012 Kokubo ..... F01L 1/352 123/90.15
2015/0176443 A1* 6/2015 Frank ..... F01L 1/352 474/111
2015/0322826 A1* 11/2015 Yamanaka ..... F01L 1/352 123/90.18
2016/0024977 A1* 1/2016 Takahashi ..... F01L 1/34 123/90.15

OTHER PUBLICATIONS

International Search Report (PCT/ISA/210) dated Dec. 6, 2016, by the Japan Patent Office as the International Searching Authority for International Application No. PCT/JP2016/077523.
Written Opinion (PCT/ISA/237) dated Dec. 6, 2016, by the Japan Patent Office as the International Searching Authority for International Application No. PCT/JP2016/077523.

* cited by examiner

VALVE OPENING AND CLOSING TIMING CONTROL APPARATUS

TECHNICAL FIELD

This invention pertains to a valve opening and closing timing control apparatus which specifies a relative rotational phase between a driving-side rotational member and a driven-side rotational member by an electric actuator.

BACKGROUND ART

Patent document 1 discloses a technique as a valve opening and closing timing control apparatus including the aforementioned construction, the valve opening and closing timing control apparatus including a hypo-cycloid deceleration mechanism where a ring gear is fixed to an inner peripheral wall of a driving-side rotational member (a sprocket in Patent document 1), and an inner gear (a planetary gear in Patent document 1) is supported at an eccentric shaft eccentric to a center axis of the driving-side rotational member, a part of teeth provided at the inner gear being meshed with a part of teeth provided at an inner periphery of the ring gear. Patent document 1 discloses a construction including an electric actuator (an electromagnetic portion in Patent document 1) and a driven-side rotational member (an output shaft in Patent document 1) which is connected to a camshaft and at which plural engagement bores are formed, the plural engagement bores engaging with engagement projections of the inner gear.

According to the aforementioned construction, the inner gear rotates by driving of the electric actuator relative to the ring gear by an angle corresponding to a difference between the number of teeth of the ring gear and the number of teeth of the inner gear based on revolution of the inner gear which is supported at the eccentric shaft. Because the engagement projections of the inner gear engage with the engagement bores of the driven-side rotational member, the driven-side rotational member rotates by an angle corresponding to a rotation angle of the inner gear relative to the driven-side rotational member as a result of driving of the electric actuator.

DOCUMENT OF PRIOR ART

Patent Document

Patent document 1: JP2004-3419A

OVERVIEW OF INVENTION

Problem to be Solved by Invention

According to the technique in Patent document 1, while the revolution of the inner gear about the eccentric shaft is allowed, the aforementioned revolution is transmitted to the driven-side rotational member (output shaft). Therefore, an inner diameter of the engagement bore provided at the driven-side rotational member is specified greater than an outer diameter of the engagement projection.

Nevertheless, in the construction where a rotational force is transmitted by the engagement of the engagement projection with the engagement bore as in the technique disclosed in Patent document 1, an outer periphery of the engagement projection necessarily constantly makes contact with an inner periphery of the engagement bore with no clearance while the engagement bore and the engagement projection are highly accurately formed so that an excess stress is not generated upon contact between the outer periphery of the engagement projection and the inner periphery of the engagement bore.

Specifically, in the construction where the engagement projection engages with the engagement bore, because the rotational force is transmitted via a small surface where the outer periphery of the engagement projection makes contact with the inner periphery of the engagement bore, the plural engagement bores and the plural engagement projections are necessary for restraining stress concentration. Thus, time and accuracy are required upon processing, which may require improvement.

In addition, according to the deceleration mechanism such as in the valve opening and closing timing control apparatus disclosed in Patent document 1 where the gears including the large number of teeth are combined, lubricant is supplied to an inside of the deceleration mechanism for enhancing meshing of the gears. That is, a technique for enhancing discharge of lubricant is also required.

Accordingly, a valve opening and closing timing control apparatus including a deceleration apparatus where an inner gear revolves about an eccentric axis is desirably constructed so that a mechanism for linking the inner gear and a driven-side rotational member is restrained from receiving stress concentration.

Means for Solving Problem

The present invention is characterized by including a driving-side rotational member rotating synchronously with a crankshaft of an internal combustion engine about a rotation axis of the driving-side rotational member, a driven-side rotational member arranged coaxially with the rotation axis of the driving-side rotational member and rotatable relative to the driving-side rotational member, the driven-side rotational member rotating integrally with a camshaft for opening and closing a valve of the internal combustion engine, and a phase adjustment mechanism specifying a relative rotational phase between the driving-side rotational member and the driven-side rotational member by an electric actuator, the phase adjustment mechanism including a ring gear arranged coaxially with the rotation axis, the ring gear including internal teeth and serving as the driven-side rotational member, an inner gear arranged coaxially with an eccentric axis which is in parallel with the rotation axis, the inner gear including external teeth of which number is different from a number of teeth of the ring gear, and a linkage mechanism which brings the inner gear to be linked to the driving-side rotational member, the phase adjustment mechanism being constructed as a differential deceleration mechanism where the inner gear is rotated relative to the ring gear by revolution of a position of the eccentric axis with reference to the rotation axis by a driving force of the electric actuator in a state where a part of a teeth portion of the ring gear is meshed with a part of a teeth portion of the inner gear, the linkage mechanism being constructed by including a coupling member at which a first engagement portion engaging with the driving-side rotational member in a displaceable manner in a first direction serving as a radial direction and a second engagement portion engaging with the inner gear in a displaceable manner in a second direction orthogonal to the first direction are integrally provided on an imaginary plane orthogonal to the rotation axis.

Accordingly, in a case of the revolution of the position of the eccentric axis with reference to the rotation axis by the electric actuator, the first engagement portion of the coupling member is displaced in the first direction relative to the driving-side rotational member while the second engagement portion of the coupling member is displaced in the second direction relative to the inner gear with the revolution of the inner gear. Thus, the coupling member receives the displacement of the inner gear in the rotation direction. Because the rotation of the inner gear relative to the driving-side rotational member is restricted by the coupling member, the driven-side rotational member is rotated relative to the driving-side rotational member. Specifically, in the present construction, the first engagement portion and the second engagement portion are constructed to perform a linear movement. Each of the first engagement portion and the second engagement portion may be therefore constructed to receive a rotation force at a large surface, which may eliminate stress concentration. Accordingly, in the valve opening and closing timing control apparatus including the deceleration apparatus where the inner gear revolves about the eccentric axis, the stress concentration at the linkage mechanism which brings the inner gear and the driving-side rotational member to be linked to each other is restrained. Further, because the first engagement portion and the second engagement portion are integrally provided on the imaginary Plane orthogonal to the rotation axis, a thickness of the coupling member is restrained from increasing, thereby achieving downsizing of the valve opening and closing timing control apparatus.

In the present invention, the linkage mechanism may be constructed by including a penetration groove which penetrates through from an inner space to an outer space of the driving-side rotational member along the first direction and the coupling member including the first engagement portion formed in an arm form for engagement with the penetration groove.

Accordingly, the first engagement portion formed in the arm form is brought to engage with the penetration groove, so that a linear displacement along the first direction may be stably performed. In addition, because the penetration groove is formed through from the inner space to the outer space of the driving-side rotational member, lubricant in the inner space is discharged to the outside through the penetration groove by inertia force in a case where the driving-side rotational member is rotated. The lubricant is effectively circulated so that dust and dirt at the inside may be effectively discharged.

In the present invention, the driving-side rotational member may be constituted by an outer case including an inner space which houses the phase adjustment mechanism and a plate covering the outer case, the penetration groove being provided at the outer case.

Accordingly, because the penetration groove is provided at the outer case which is formed to be thick for securing the inner space in the direction along the rotation axis, a groove depth of the penetration groove may increase, which may make the first engagement portion which engages with the penetration groove to be thick. As a result, strength of engagement may easily increase. Further, because the penetration groove is provided, the lubricant at the inside of the outer case where the lubricant is largely stored may be positively discharged.

In the present invention, the plate may include a projecting portion at an inner surface for positioning the ring gear in a direction along the rotation axis by making contact with the ring gear.

Accordingly, the projecting portion provided at the inner surface of the plate makes contact with the ring gear so as to stabilize the position of the ring gear in the direction along the rotation axis.

MODE FOR CARRYING OUT THE INVENTION

Figure 1:
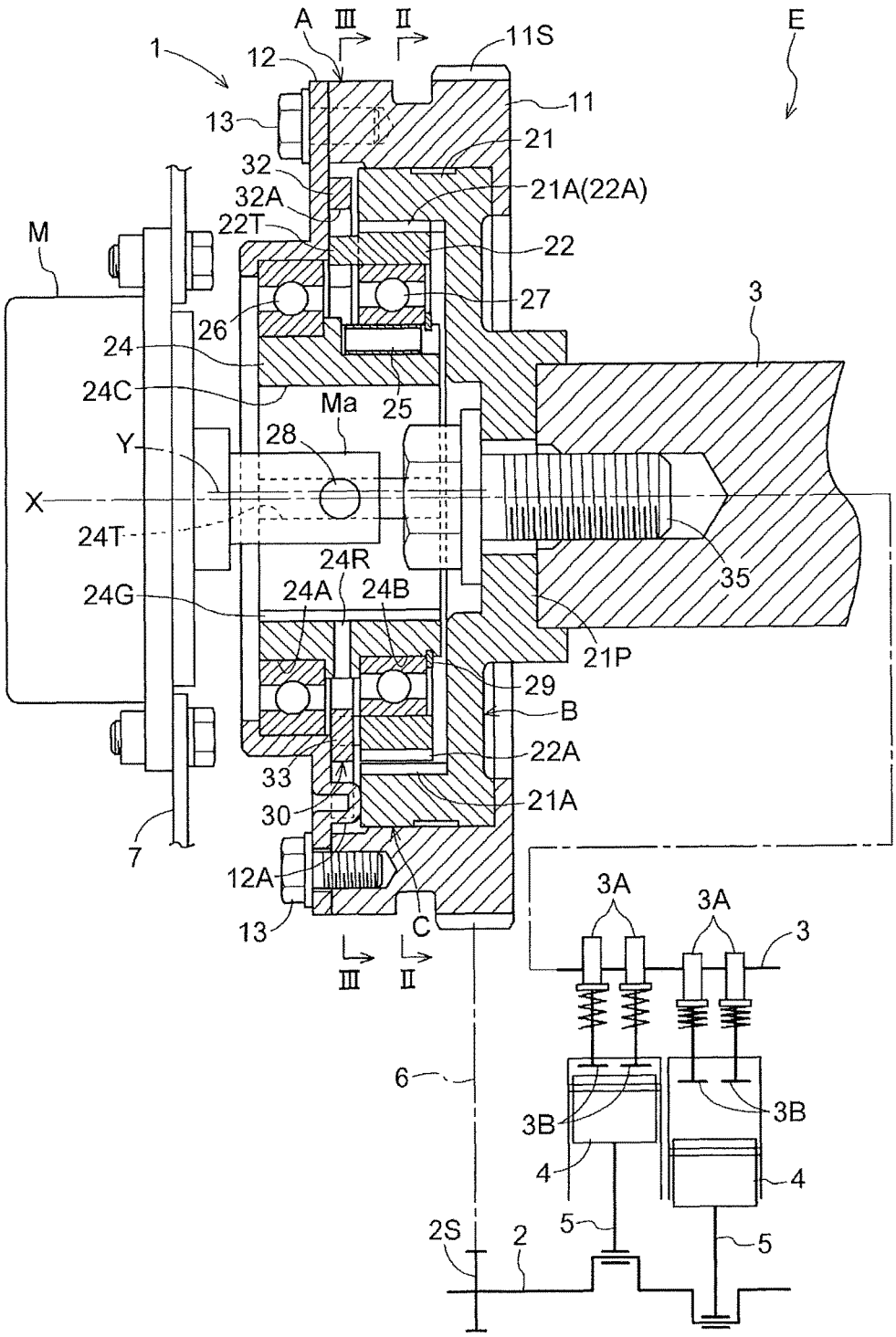
FIG. 1 is a cross-sectional view of a valve opening and closing timing control apparatus.

An embodiment of the invention is explained with reference to the attached drawings.

[Basic Construction]

As illustrated in FIGS. 1 to 4, a valve opening and closing timing control apparatus 1 is constructed by including a driving-side rotational member A rotating synchronously with a crankshaft 2 of an engine E which serves as an internal combustion engine, a driven-side rotational member B rotating integrally with an intake camshaft 3, and a phase adjustment mechanism C specifying a relative rotational phase between the driving-side rotational member A and the driven-side rotational member B by a driving force of a phase control motor M (an example of an electric actuator).

The engine E is constructed as a four-cycle engine where pistons 4 housed in plural cylinder bores provided at a cylinder block are connected to the crankshaft 2 by respective connecting rods 5. A timing belt 6 (which may be a timing chain, for example) is wound over from an output pulley 2S of the crankshaft 2 of the engine E to a drive pulley 11S of the driving-side rotational member A.

Accordingly, the valve opening and closing timing control apparatus 1 entirely rotates about a rotation axis X in a state where the engine E is operated. The driven-side rotational member B is constructed to be displaceable in the same direction as the rotation direction or an opposite direction relative to the driving-side rotational member A by driving of the phase adjustment mechanism C.

In the valve opening and closing timing control apparatus 1, driving of the phase control motor M is controlled by a control unit such as an ECU, for example, to thereby specify the relative rotational phase between the driving-side rotational member A and the driven-side rotational member B by the phase adjustment mechanism C. By specifying the relative rotational phase in the aforementioned manner, opening and closing timing of each intake valve 3B controlled by each cam portion 3A is achieved.

[Valve opening and closing timing control apparatus] In the driving-side rotational member A, an outer case 11 at which the drive pulley 11S is provided and a front plate 12 are fastened together by plural fastening bolts 13. In an inner space of the outer case 11, the driven-side rotational member B and the phase adjustment mechanism C constructed as a hypotrochoid reduction gear (a specific example of a differential deceleration mechanism) are housed.

The driven-side rotational member B is constituted by a ring gear 21 at which an internal teeth portion 21A including a number of internal teeth is formed. The phase adjustment mechanism C is constituted by the ring gear 21, an inner gear 22 at which an external teeth portion 22A including a number of external teeth is formed, a drive shaft 24 linked to the inner gear 22, and a coupling member 30 serving as a linkage mechanism which brings the inner gear 22 to be linked to the driving-side rotational member A.

Figure 2:
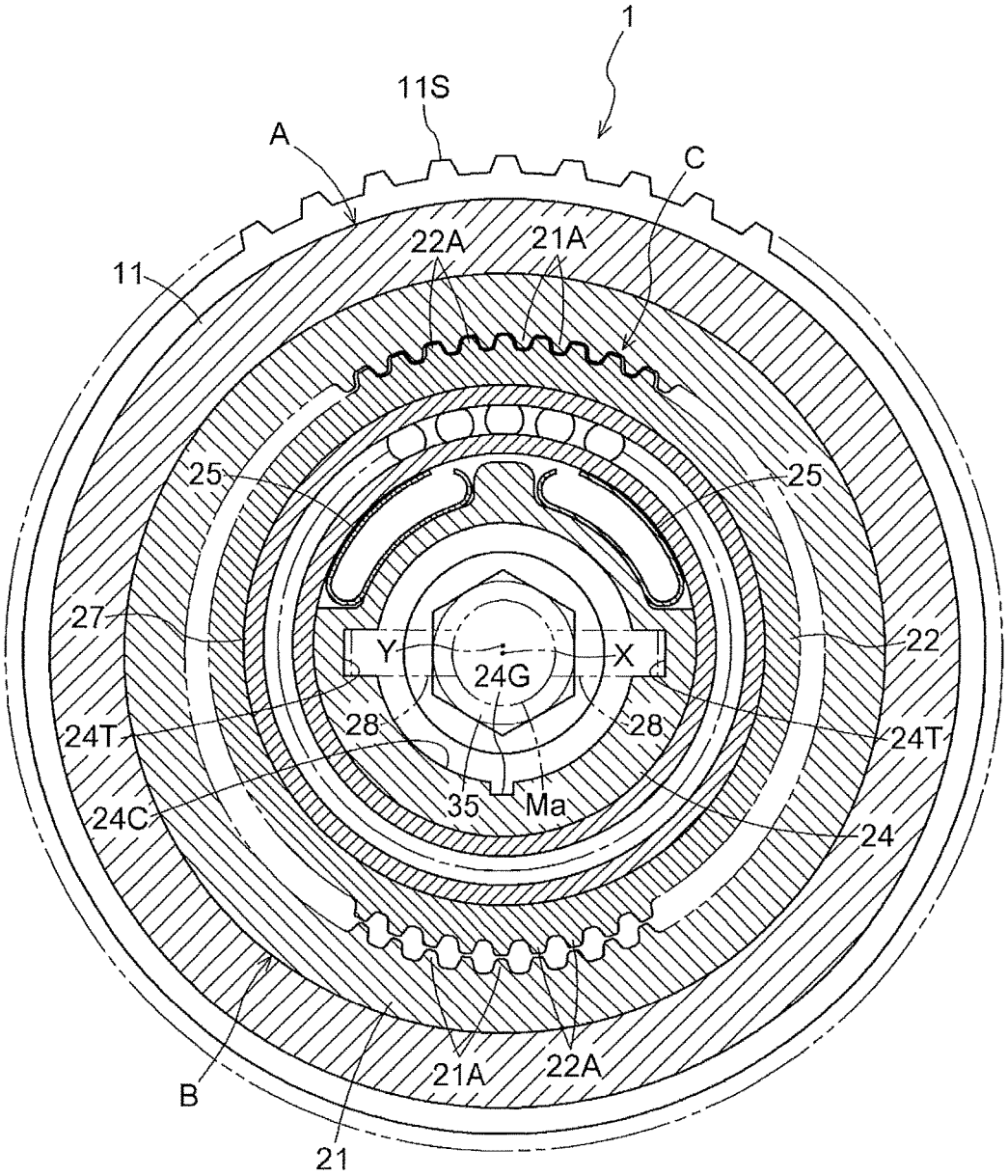
FIG. 2 is a cross-sectional view taken along a line II-II in FIG. 1.

As illustrated in FIG. 2, the ring gear 21 is arranged coaxially with the rotation axis X and the inner gear 22 is arranged coaxially with an eccentric axis Y which is in parallel with the rotation axis X. A part of the external teeth portion 22A is meshed with a part of the internal teeth portion 21A. The number of teeth of the external teeth portion 22A of the inner gear 22 is less by one than the number of teeth of the internal teeth portion 21A of the ring gear 21.

The phase control motor M (an electric motor) is supported at the engine E by a support frame 7 so that an output shaft Ma of the phase control motor M is arranged coaxially with the rotation axis X.

The ring gear 21 includes a construction where a driven plate 21P arranged orthogonal to the rotation axis X is integrally provided with a ring-formed portion at which the internal teeth portion 21A is provided. A connection bolt 35 is inserted to be positioned within a bore portion at a center of the driven plate 21P to be meshed with the intake camshaft 3. As a result, the ring gear 21 is connected to the intake camshaft 3 so as to be coaxial with the rotation axis X.

The drive shaft 24 includes a first support portion 24A at an outer end side in a direction along the rotation axis X and a second support portion 24B at an inner end side in the direction along the rotation axis X. The first support portion 24A forms an outer peripheral surface with reference to the rotation axis X and the second support portion 24B forms an outer peripheral surface with reference to the eccentric axis Y. A pair of cut portions is formed at the outer periphery of the second support portion 24B so that spring members 25 are fitted in the respective cut portions. The drive shaft 24 also includes a bore portion 24C with reference to the rotation axis X. A pair of engagement grooves 24T is formed at the bore portion 24C so as to be parallel with the rotation axis X. Engagement members 28 of the output shaft Ma of the phase control motor M engage with the pair of engagement grooves 24T.

A single lubrication groove 24G in parallel with the rotation axis X is formed at the bore portion 24C. A lubrication passage 24R is formed by penetrating through from the lubrication groove 24G to an outer surface and a pair of lubrication passages 24R is formed by penetrating through from the pair of engagement grooves 24T to the outer surface (see FIG. 3).

As illustrated in FIG. 1, a first ball bearing 26 is fitted in an opening at a center of the front plate 12. The first support portion 24A is inserted to be positioned within the first ball bearing 26 so that the drive shaft 24 is rotatably supported relative to the driving-side rotational member A with reference to the rotation axis X.

In addition, a second ball bearing 27 is externally fitted to the second support portion 24B of the drive shaft 24 and is fitted in the pair of cut portions of the drive shaft 24 so that a biasing force is applied to an inner circumference of the second ball bearing 27. The inner gear 22 is externally fitted to the second ball bearing 27 so as to be rotatable. Further, a C-ring 29 serving as a retaining ring is provided to inhibit the second ball bearing 27 from disengaging from the second support portion 24B.

Accordingly, the part of the external teeth portion 22A of the inner gear 22 is meshed with the part of the internal teeth portion 21A of the ring gear 21 while the inner gear 22 is supported to be rotatable with reference to the eccentric axis Y. The aforementioned meshing is held by the biasing force of the pair of spring members 25.

[Phase Adjustment Mechanism: Coupling Member]

The coupling member 30 constituting the linkage mechanism is manufactured by press working on a plate-formed member. The coupling member 30 integrally includes a pair of first engagement arms 31 (each of which serves as an example of a first engagement portion) protruding outwardly with reference to the rotation axis X, a pair of second engagement arms 32 (each of which serves as an example of a second engagement portion) protruding in a direction orthogonal to the first engagement arms 31, and a ring-formed portion 33 connecting the first engagement arms 31 and the second engagement arms 32. Engagement recess portions 32A are formed at the respective second engagement arms 32 (the example of the second engagement portion) so as to open towards the rotation axis X.

The pair of first engagement arms 31, the pair of second engagement arms 32 and the ring-formed portion 33 connecting the first engagement arms 31 and the second engagement arms 32 are arranged on an imaginary plane orthogonal to the rotation axis X.

Each of the first engagement arms 31 (the example of the first engagement portion) is constituted in a plate-formed region which linearly extends along a first direction as viewed in the direction along the rotation axis X. Each of the engagement recess portions 32A of the second engagement arms 32 (the example of the second engagement portion) is formed in a recess form recessed along a second direction as viewed in the direction along the rotation axis X.

A pair of first linkage portions AT (each of which serves as a specific example of a penetration groove) is formed as a penetration groove at a connection surface of the outer case 11 constituting the driving-side rotational member A, the connection surface making contact with the front plate 12. Each of the first linkage portions AT extends in a radial direction with reference to the rotation axis X from the inner space to an outer space of the outer case 11. A direction of a straight line where the pair of first linkage portions AT is arranged side by side corresponds to the first direction (i.e., a left-right direction in FIG. 3). A pair of second linkage portions 22T is formed as protrusions at positions in an end surface of the inner gear 22, the positions being opposed to each other with reference to the eccentric axis Y. A direction where the pair of second linkage portions 22T is arranged side by side corresponds to the second direction (i.e., an up-down direction in FIG. 3).

Figure 3:
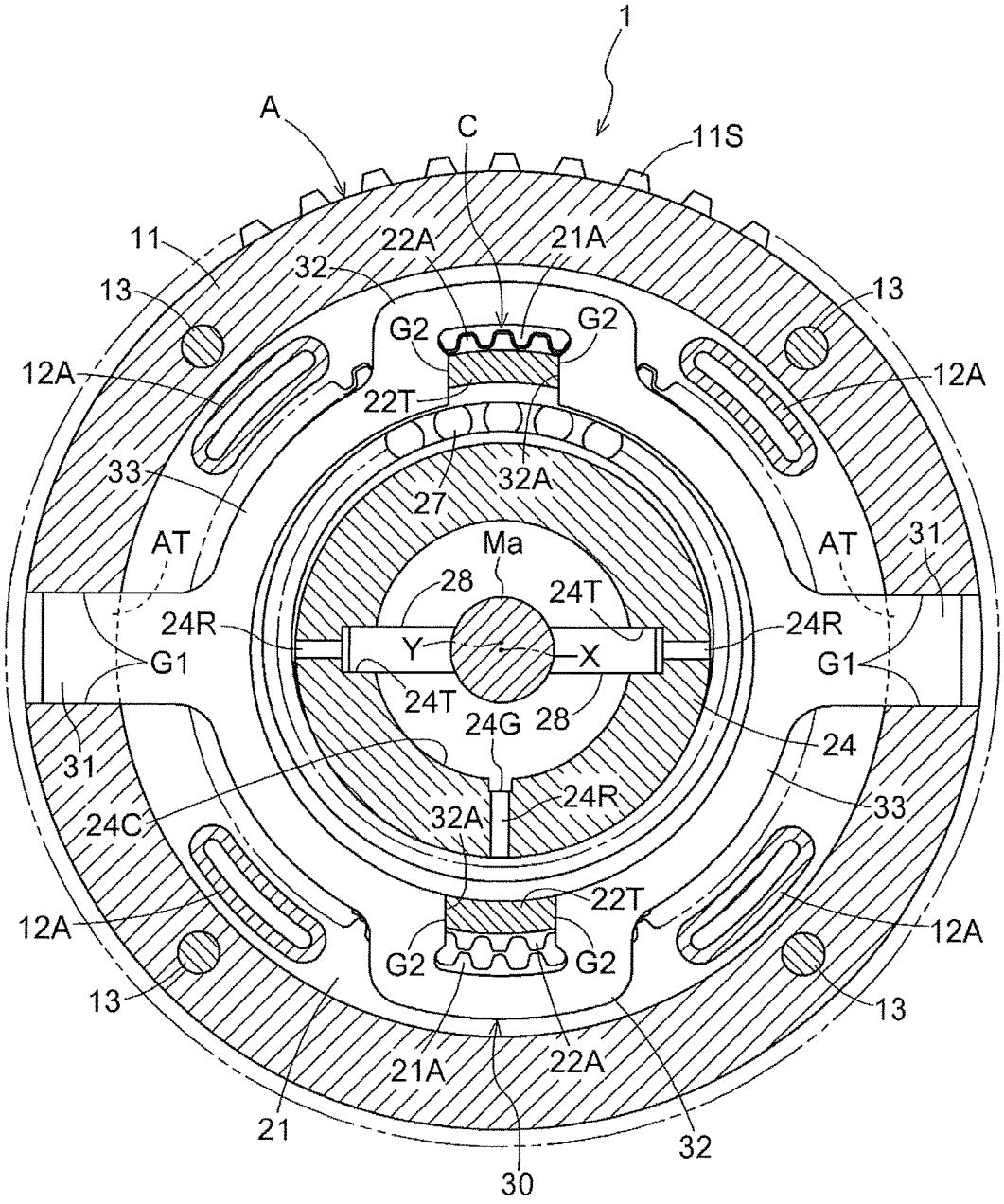
FIG. 3 is a cross-sectional view taken along a line III-III in FIG. 1.

As illustrated in FIG. 3, each of the first linkage portions AT includes a pair of first guide surfaces G1 formed in parallel with the first direction as viewed in the direction along the rotation axis X. Each of the second linkage portions 22T is formed in a rectangular form while including a pair of second guide surfaces G2 formed in parallel with the second direction as viewed in the direction along the rotation axis X.

In the aforementioned construction, the first engagement arms 31 of the coupling member 30 are brought to engage with the first linkage portions AT while the engagement recess portions 32A of the second engagement arms 32 of the coupling member 30 are brought to engage with the second linkage portions 22T so that the coupling member 30 may function as an Oldham coupling.

Based on the aforementioned engagement, a positional relationship where linear portions of the first engagement arm 31 make contact with the first guide surfaces G1 of the first linkage portion AT and linear portions in the recess portion of the second engagement arm 32 make contact with the second guide surfaces G2 of the second linkage portion 22T is obtained.

Figure 4:
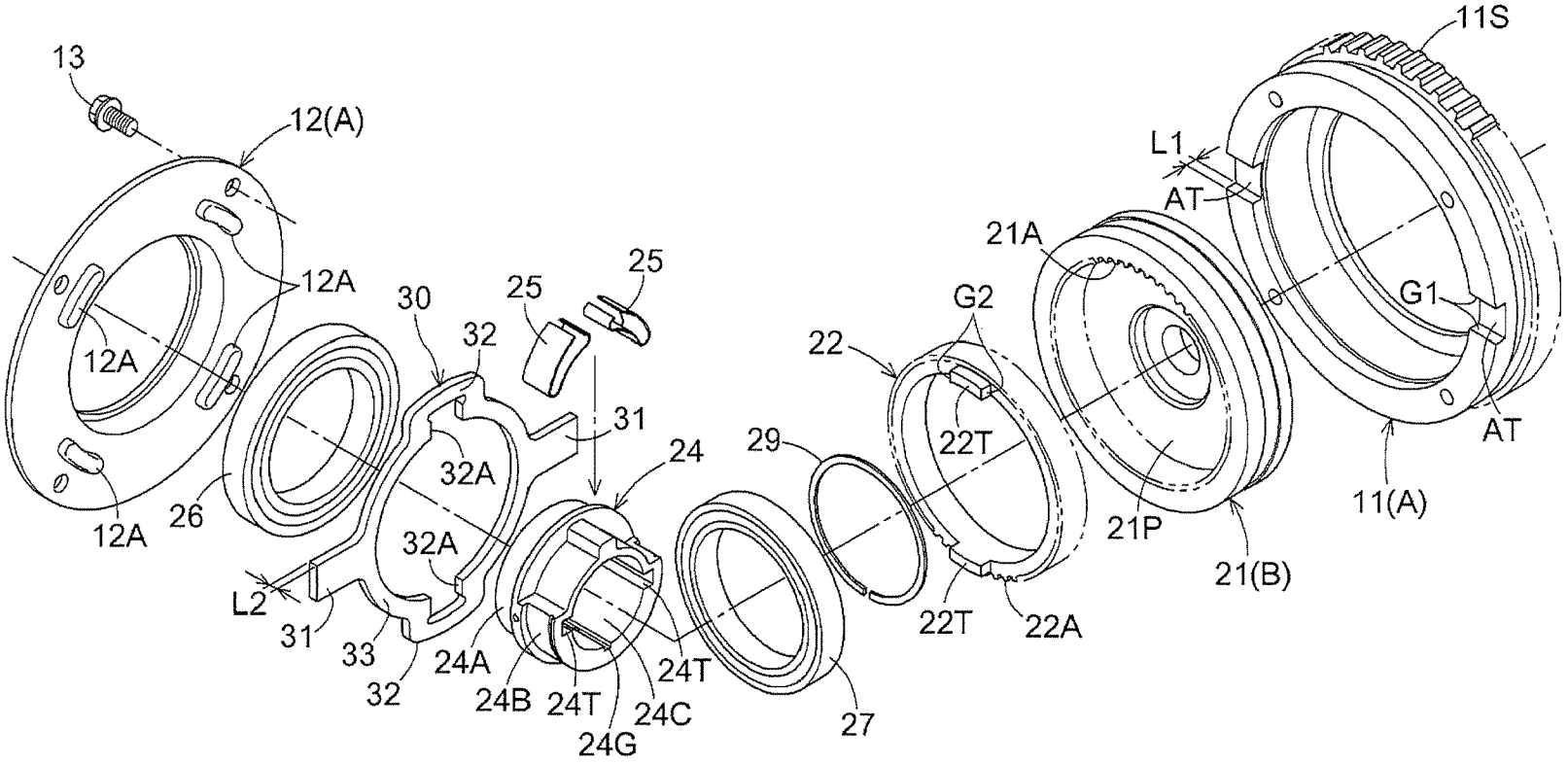
FIG. 4 is an exploded perspective view of the valve opening and closing timing control apparatus.

As illustrated in FIG. 4, a groove depth L1 of the first linkage portion AT is specified sufficiently greater than a thickness L2 of the first engagement arm 31. Thus, a front surface of the first engagement arm 31 makes contact with the front plate 12 while a clearance is defined between a rear surface of the first engagement arm 31 and a bottom portion of the first linkage portion AT.

Plural projecting portions 12A are provided at an inner surface of the front plate 12 so as to position the ring gear 21 in the direction along the rotation axis X by making contact with an end surface of the ring gear 21.

[Operation of Phase Adjustment Mechanism]

The output shaft Ma of the phase control motor M is driven to rotate at a faster speed or a slower speed than the rotation speed of the intake camshaft 3 so as to bring the eccentric axis Y of the second support portion 24B to revolve about the rotation axis X. Because of the aforementioned revolution, meshing position of the internal teeth portion 21A of the ring gear 21 with the external teeth portion 22A of the inner gear 22 moves along an inner circumference of the ring gear 21, so that the inner gear 22 may rotate with reference to the eccentric axis Y.

In a case where the eccentric axis Y of the inner gear 22 revolves about the rotation axis X, displacement of the inner gear 22 is transmitted to the engagement recess portions 32A from the second linkage portions 22T. In a case where the displacement includes a component in the first direction, the coupling member 30 is displaced in the first direction with the displacement of the inner gear 22. In a case where the displacement includes a component in the second direction, the coupling member 30 is inhibited from being displaced and the inner gear 22 only is displaced in the second direction. It is understandable that the coupling member 30 may be displaced simultaneously in the first direction and the second direction.

The number of teeth of the external teeth portion 22A of the inner gear 22 is specified less by one than the number of teeth of the internal teeth portion 21A of the ring gear 21. Thus, in a case of one revolution of the eccentric axis Y of the inner gear 22 about the rotation axis X, the ring gear 21 rotates by one tooth, which realizes a large deceleration.

In the aforementioned construction, the relative rotation between the inner gear 22 and the outer case 11 which constitutes the driving-side rotational member A is restricted by the coupling member 30. Thus, the ring gear 21 rotates with reference to the rotation axis X by a rotation force applied in a direction where the inner gear 22 rotates with the revolution of the inner gear 22. That is, by the revolution of the inner gear 22 relative to the ring gear 21, the ring gear 21 rotates with reference to the driving-side rotational member A. As a result, the relative rotational phase between the driving-side rotational member A and the driven-side rotational member B are specified to achieve setting of the opening and closing timing by the intake camshaft 3.

Effects of Embodiment

According to the aforementioned construction, in a case where the eccentric axis Y of the inner gear 22 revolves relative to the ring gear 21, the coupling member 30 is displaced in the first direction and the second direction. Thus, the relative rotation between the inner gear 22 and the driving-side rotational member A is interfered and the intake camshaft 3 connected to the ring gear 21 (driven-side rotational member B) is rotated relative to the driving-side rotational member A. In addition, because the coupling member 30 which may be formed thinner by press working on the plate-formed member is provided, the thickness of the valve opening and closing timing control apparatus 1 may be reduced.

For example, in a case where the coupling member 30 is displaced in the first direction, each of the first engagement arms 31 is guided by the first guide surfaces G1 of the first linkage portion AT in a state of slidably contacting the first guide surfaces G1. In a case where the coupling member 30 is displaced in the second direction, the engagement recess portion 32A of each of the second engagement arms 32 is guided by the second guide surfaces G2 of the second linkage portion 22T in a state of slidably contacting with the second guide surfaces G2. Because of the aforementioned guiding, smooth linear displacement is performed at each sliding portion so that the sliding portion is inhibited from locally receiving stress.

The valve opening and closing timing control apparatus 1 is arranged at an inner portion of a chain case that drives the intake camshaft 3 and an exhaust camshaft of the engine E. Because of such positional relationship, a part of lubricant supplied to the camshaft or a chain flows into the bore portion 24C of the drive shaft 24 from the opening at the center of the front plate 12 and is supplied to each portion in the inner space of the outer case 11, thereby smoothly operating the phase adjustment mechanism C.

That is, the lubricant flowing into the bore portion 24C is supplied to an inner portion of the ring gear 21 from an inner end position and is supplied between the internal teeth portion 21A of the ring gear 21 and the external teeth portion 22A of the inner gear 22 to thereafter flow to the inner space of the outer case 11. A part of the lubricant flowing to the bore portion 24C flows to an outer surface of the drive shaft 24 from the plural lubrication grooves 24G so as to be supplied to between the first engagement arms 31 of the coupling member 30 and the first linkage portions AT and between the second engagement arms 32 and the second linkage portions 22T.

Specifically, because the valve opening and closing timing control apparatus 1 rotates, the lubricant at the inner space of the outer case 11 and the lubricant supplied to the first engagement arms 31 are discharged to the outside by inertia force through a clearance between each of the first linkage portions AT and the first engagement arms 31. Because the lubricant is discharged to the outside through the clearance, dust and dirt at the inner space may be discharged together with the lubricant, for example.

In addition, because the plural projecting portions 12A provided at the inner surface of the front plate 12 are arranged contactable with the end surface of the ring gear 21, the position of the ring gear 21 in the direction along the rotation axis X is determined.

Other Embodiments

The present invention may be constructed as below, in addition to the aforementioned embodiment (components including the same functions as the embodiment bear the same reference numerals as the embodiment).

(a) The first linkage portions AT which engage with the respective first engagement arms 31 may be provided at the front plate 12. In addition, grooves may be formed at opposed surfaces of the outer case 11 and the front plate 12 along the first direction to constitute the first linkage portions AT.

(b) Even in a case where the first linkage portions AT are formed at any of the outer case 11 and the front plate 12, the construction where the first linkage portion AT extends through from the inner space to the outer space of the outer case 11 is not necessarily employed. The first linkage portion AT may be a sac hole not being communicated to the outer space.

(c) The first linkage portion AT may be constructed so that a recess portion in a groove formed at the first engagement arm 31 may be fitted to a guide member provided in a projecting form at the outer case 11 so as to be movable relative to the guide member.

(d) The second linkage portion 22T may be constructed so that a groove portion which radially extends is formed at the end surface of the inner gear 22 and a member that is fitted in the groove portion may be provided at the coupling member 30.

INDUSTRIAL APPLICABILITY

The present invention is applicable to a valve opening and closing timing control apparatus including a phase adjustment mechanism where external teeth of an inner gear are meshed with internal teeth of a ring gear.

EXPLANATION OF REFERENCE NUMERALS

1 valve opening and closing timing control apparatus
2 crank shaft
3 camshaft (intake camshaft)
11 outer case
12 plate (front plate)
12A projecting portion
21 ring gear
21A teeth portion (internal teeth portion)
22 inner gear
22A teeth portion (external teeth portion)
30 linkage mechanism, coupling member
31 first engagement portion (first engagement arm)
32 second engagement portion (second engagement arm)
A driving-side rotational member
AT penetration groove
B driven-side rotational member
C phase adjustment mechanism
E internal combustion engine (engine)
M electric actuator (phase control motor)
X rotation axis
Y eccentric axis

The invention claimed is:

1. A valve opening and closing timing control apparatus comprising:

a driving-side rotational member rotating synchronously with a crankshaft of an internal combustion engine about a rotation axis of the driving-side rotational member;

a driven-side rotational member arranged coaxially with the rotation axis of the driving-side rotational member and rotatable relative to the driving-side rotational member, the driven-side rotational member rotating integrally with a camshaft for opening and closing a valve of the internal combustion engine; and a phase adjustment mechanism specifying a relative rotational phase between the driving-side rotational member and the driven-side rotational member by an electric actuator, the phase adjustment mechanism including a ring gear arranged coaxially with the rotation axis, the ring gear including internal teeth and serving as the driven-side rotational member, an inner gear arranged coaxially with an eccentric axis which is parallel with the rotation axis, the inner gear including external teeth of which number is different from a number of the internal teeth of the ring gear, and a linkage mechanism which brings the inner gear to be linked to the driving-side rotational member, the phase adjustment mechanism being constructed as a differential deceleration mechanism where the inner gear is rotated relative to the ring gear by revolution of a position of the eccentric axis with respect to the rotation axis by a driving force of the electric actuator in a state where a part of a teeth portion of the ring gear is meshed with a part of a teeth portion of the inner gear, the linkage mechanism being constructed by including a coupling member at which a first engagement portion engaging with the driving-side rotational member in a displaceable manner in a first direction serving as a radial direction and a second engagement portion engaging with the inner gear in a displaceable manner in a second direction orthogonal to the first direction are integrally provided on an imaginary plane orthogonal to the rotation axis, wherein the linkage mechanism is constructed by including a penetration groove which penetrates through from an inner space to an outer space of the driving-side rotational member along the first direction and the coupling member including the first engagement portion formed in an arm form for engagement with the penetration groove, and the driving-side rotational member is constituted by an outer case including an inner space which houses the phase adjustment mechanism and a plate covering the outer case, the penetration groove being provided at the outer case.

2. The valve opening and closing timing control apparatus according to claim 1, wherein the plate includes a projecting portion at an inner surface for positioning the ring gear in a direction along the rotation axis by making contact with the ring gear.

* * * * *